US007463858B2

(12) United States Patent
Shiokawa et al.

(10) Patent No.: US 7,463,858 B2
(45) Date of Patent: Dec. 9, 2008

(54) FIXING DEVICE AND IMAGE FORMING APPARATUS WITH HORIZONTALLY MOVING SEPARATING CLAW

(75) Inventors: Yasuo Shiokawa, Hachioji (JP); Akira Kosugi, Hachioji (JP); Ritsuo Fujii, Hachioji (JP)

(73) Assignee: Konica Minota Business Technologies, Inc., Tokyo (JP)

( * ) Notice: Subject to any disclaimer, the term of this patent is extended or adjusted under 35 U.S.C. 154(b) by 149 days.

(21) Appl. No.: 11/446,773

(22) Filed: Jun. 5, 2006

(65) Prior Publication Data

US 2007/0053728 A1 Mar. 8, 2007

(30) Foreign Application Priority Data

Sep. 8, 2005 (JP) ..... 2005-260424

(51) Int. Cl.
*G03G 15/20* (2006.01)

(52) U.S. Cl. ..... 399/323

(58) Field of Classification Search ..... 399/323
See application file for complete search history.

(56) References Cited

U.S. PATENT DOCUMENTS 6,650,862 B2 * 11/2003 Nakano et al. ..... 399/323
6,735,412 B2 * 5/2004 Berg et al. ..... 399/323
2006/0269332 A1 * 11/2006 Yamanaka et al. ..... 399/323

* cited by examiner

*Primary Examiner*—Ryan Gleitz
(74) *Attorney, Agent, or Firm*—Lucas & Mercanti, LLP

(57) ABSTRACT

The fixing device and image forming apparatus employ a horizontally moving claw for separating a sheet on which a toner image has been fixed. The claw moves in a horizontally reciprocating manner at a velocity between 0.001 mm/seconds to 0.1 mm/seconds. Moving at that speed, it has been found to reduce scratching of the fixing drum. The device and image forming apparatus also employ a claw having a width between 1.0 mm and 5.0 mm. The claw contacts the drum with a pressure in a range of 3.0×9.8 mN to 7.0×9.8 mN.

4 Claims, 6 Drawing Sheets

FIXING DEVICE AND IMAGE FORMING APPARATUS WITH HORIZONTALLY MOVING SEPARATING CLAW

This application claims priority from Japanese Patent Application No. 2005-260424 filed on Sep. 8, 2005, which is incorporated hereinto by reference.

BACKGROUND OF THE INVENTION

The present invention relates to a fixing device which fixes a toner image on a recording material and to an image forming apparatus having the fixing device to form an image, such as a coping machine, a printer and a facsimile machine.

The image forming apparatus such as the coping machine, the printer, and the facsimile machine utilizing an electro photographic method forms an image on the recording material by transferring a toner image from a surface of an image carrier such as a photoreceptor and an intermediate transfer member and by fixing the transferred toner image.

In a fixing device commonly used for in the image forming apparatus, a nip area is formed by 2 rollers including a heat roller and a pressure roller, and the recording material is caused to pass through the nip area to be fixed. In the nip area in the fixing device, there has been occurred a problem that the recording material enwinds the heat roller. To solve the problem, a technology to cause separating claws to make contact with a heat roller surface is proposed.

The claw is effective to prevent enwinding, however the claw makes streak line scratches on the heat roller surface. These scratches on the heat roller appear on the image of the recording material as defects, which has been a problem for image forming apparatuses which are required to have high quality. As a technology considering this point of view, there is proposed a separation claw moving device by which the separation claws are able to move in a direction parallel to a rotation axis of the heat roller and may reciprocate in a claw moving area at a constant velocity.

[Patent Document 1] Japanese Patent Publication Laid-Open No. HEI 9-160390

However, though the separation claws move in the direction parallel to the rotation axis of the heat roller, if the moving velocity of the separation claw (a separation claw's moving distance along the surface of heat roller per unit time) is low, the scratches which are sufficient to generate the defects in the image on the recording material will occur on the heat roller surface.

Also, if the moving velocity of separation claw is high, a problem occurs in performance of separation. This aspect is explained using FIG. 7. FIG. 7 is a drawing showing a status where the separation claws move along the surface of the heat roller. Numeral 1000 is the separation claw and numeral 1001 is the heat roller. The separation claws reciprocates along the surface of heat roller. If the moving velocity of separation claw 1000 is high, there is occurred a phenomenon that one side of separation claw 1000 is lifted (hereinafter called bias contact) as shown in FIG. 7. There is no problems in separation performance as long as separation claw 1000 is in contact with heat roller 1001 as shown in FIG. 7(*a*), however in bias contact condition as shown in FIG. 7(*b*), the separation claw cannot make contact sufficiently with the recording material adhering to the heat roller sufficiently, and preferable performance of separation cannot be exerted.

Therefore, an object of the present invention is to provide a fixing device and an image forming apparatus which prevents the defects of the image and the problem of separation performance of the separation claw, by focusing attention on the moving velocity of the separation claw.

SUMMARY OF THE INVENTION

To attain the aforesaid object, in the present invention, the moving velocity of the separation claw is made more appropriate.

That is, the fixing device related to the present invention includes, a fixing member to fix the toner image onto a recording material, a separation claw to separate the recording material from the fixing member, and a separation claw moving device to move the separation claw along a surface of the fixing member, and the moving velocity V of the separation claw caused by the separation claw moving device satisfies the formula below.

$$1\times10^{-3}\ \text{mm/s} \leqq V \leqq 0.1\ \text{mm/s}$$

Also, the image forming apparatus of the present invention forms the image by fixing a toner image transferred onto the recording material from an image carrying substance and includes the aforesaid fixing devices.

The fixing device and image forming apparatus of the present invention make it possible to realize excellent image forming by reducing defects in the image and to maintain separation performance of separation claw.

DETAILED DESCRIPTION OF THE PREFERRED EMBODIMENT

An embodiment of an image forming apparatus of the present invention will be described below.

Figure 1:
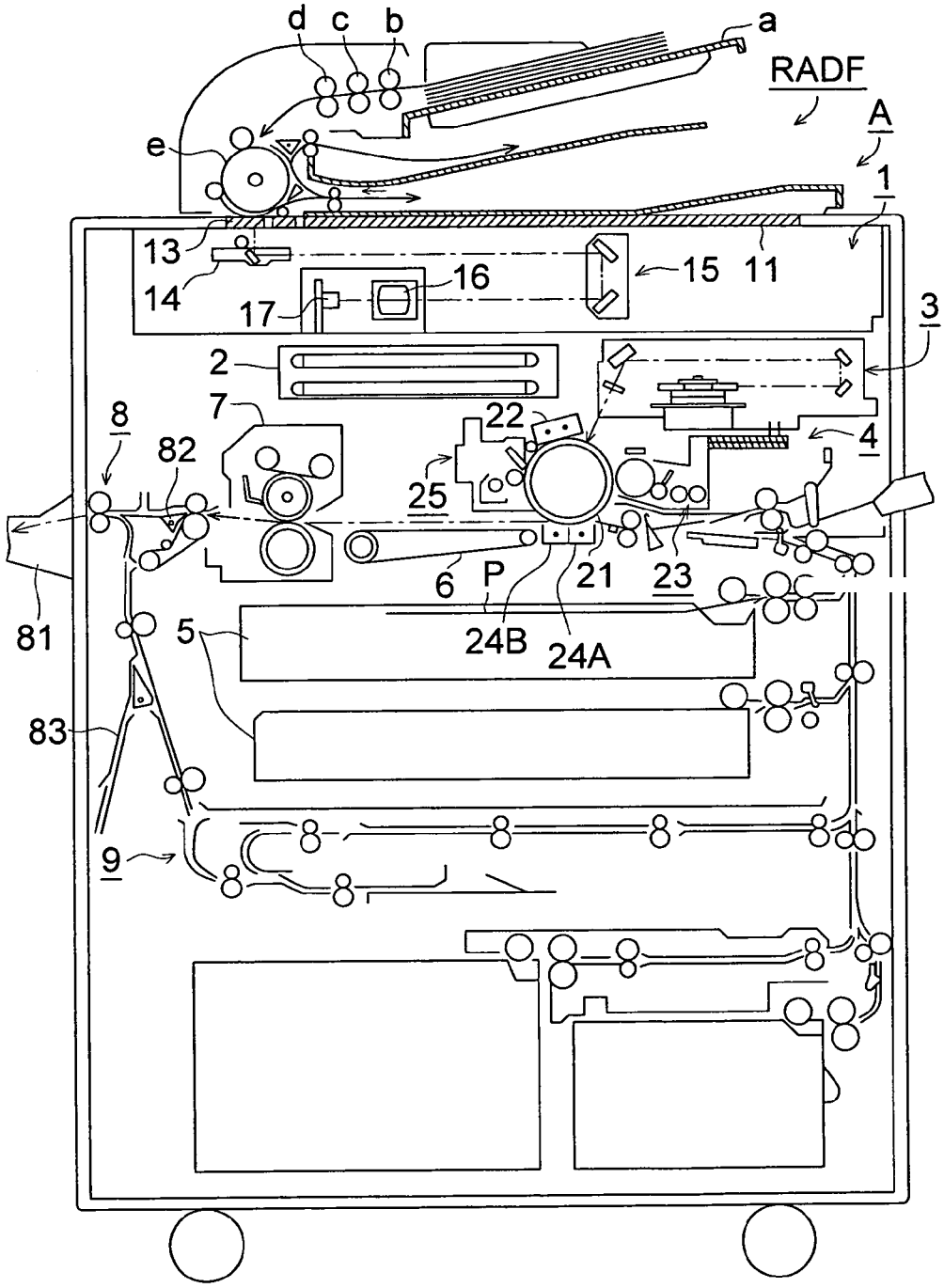
FIG. 1 is a cross sectional drawing of an image forming apparatus showing an example embodiment of the present invention.

FIG. 1 is a diagram explaining total configuration of the image forming apparatus. The image forming apparatus shown in FIG. 1 is composed of duplex document automatic feeding device RADF and image forming apparatus main body A.

Duplex document automatic feeding device RADF is located in an upper part of image forming apparatus main body A and able to be opened and closed. A document on document feeding tray a is conveyed by sheet feeding roller b, separation roller c, registration roller d and conveyance drum e.

Image forming apparatus main body A is composed of image reading device 1, control device 2, image writing device 3, image forming device 4, recording material storing device 5, conveyance transmission device 6, fixing device 7, sheet ejecting device 8, and re-conveyance device 9.

An optical system of image reading device 1 is composed of exposure unit 14 including a light source and a first mirror, V mirror unit 15 including a second mirror and a third mirror, lens 16, and CCD image sensor 17. Reading action for the document conveyed by duplex document automatic feeding device RADF is carried out while exposure unit 14 is located below slit exposure glass 13. Reading action for the document placed on document glass 11 is carried out by moving exposure unit 14 and V mirror unit 15.

An image of the document read by image reading device 1 is processed by control unit 2 and converted to signals as an image data and then stored in a memory.

Next, a process of forming an image on recording material P is explained.

Photoreceptor 21 is driven by an unillustrated main motor, electric voltage is applied to a surface of the photoreceptor 21 from an unillustrated power source, and the surface of the photoreceptor is charged in positive polarity by discharging of charging device 22 (+800V in the present embodiment). Next, optical writing in accordance with image information is carried out through image writing device 3 and an electrostatic latent image is formed on photoreceptor 21. When the electrostatic latent image formed passes through developing device 23, the toner charged in positive polarity in developing device 23 adheres onto the latent image portion by impressing positive polarity developing bias, then a toner image is formed on photoreceptor 21. The toner image formed is transferred from photoreceptor 21 to recording material P by transfer device 24A, then recording material P is separated by separating device 24B. Remaining toner on photoreceptor 21 after transfer is removed by cleaning device 25. The separated recording material P is conveyed to fixing device 7 composed of a pair of rollers including a pressure roller and a heat roller. As a result, the toner image is fixed on recording material P, then recording material P on which the image is formed is ejected by sheet ejecting device 8 to sheet ejection tray 81 which is located outside the apparatus.

Meanwhile, in case of duplex print, recording material P having an image formed on its first surface is conveyed to re-conveyance device 9 by conveyance path change over plate 82 to be reversed. Then after forming an image on the second surface again in image forming device 4, recording material P is ejected to sheet ejection tray 81 which is located outside the apparatus.

In case of inverted ejection of sheet, recording material P is branched from an ordinary sheet path by conveyance path change over plate 82. Then after being inverted by inverted ejection section 83 through switch back, recording material P is ejected by sheet ejection device 8 to sheet ejection tray 81 which is located outside the apparatus.

Figure 2:
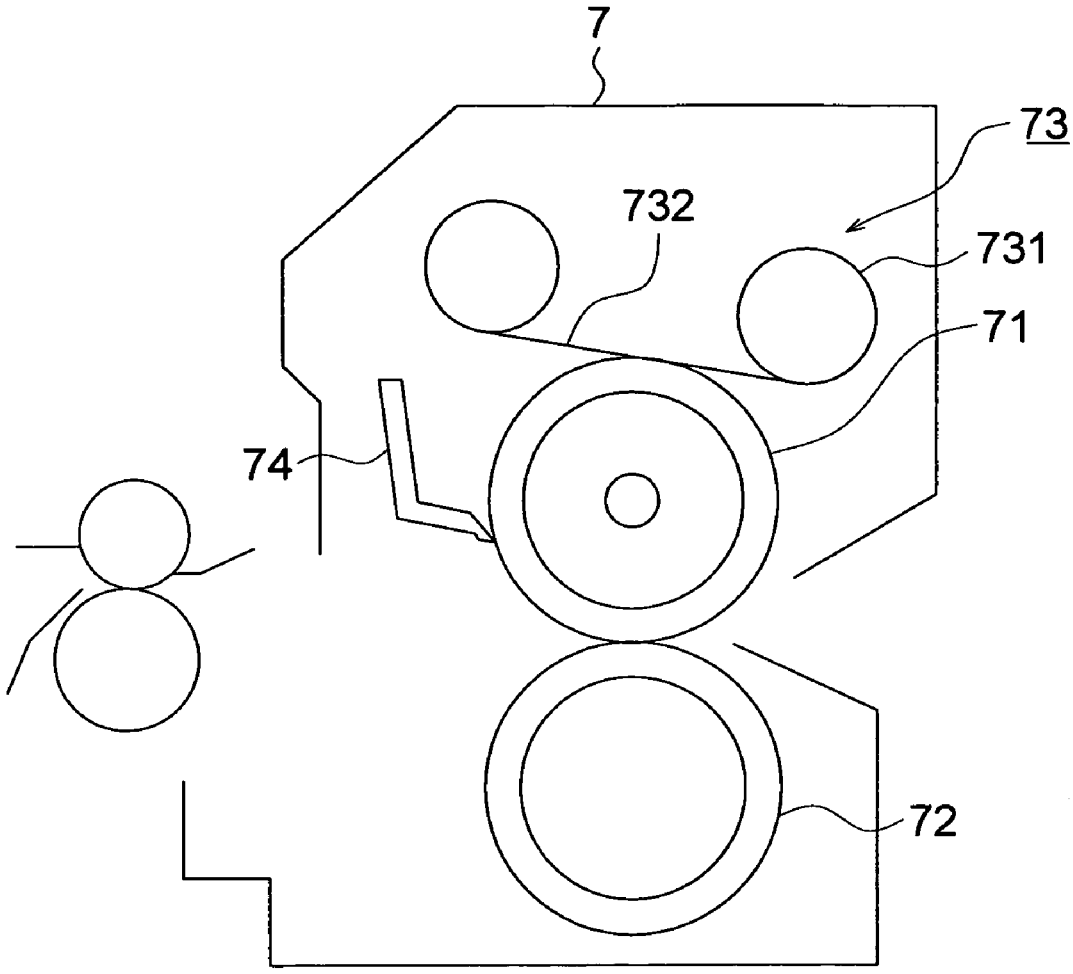
FIG. 2 is an explanatory drawing of a fixing device.

FIG. 2 is a detailed drawing of fixing device 7.

Fixing device 7 fixes the toner image onto the recording material by making the recording material go through a nip area formed with fixing member 71 and pressure member 72.

Fixing member 71 is a heat roller to melt the toner image on the recording material. Fixing member 71 is, for instance, a roller composed of a hollow aluminum core metal (thickness 14 mm) with a diameter of 70 mm whose outer circumference is covered by silicone rubber (thickness 2 mm) and is coated by PFA (perfluoroalkoxy 30 μm) having a halogen heater inside.

Pressure member 72 is, for instance, a roller in which a hollow aluminum core metal (thickness 2 mm) with a diameter of 60 mm whose outer circumference is covered by silicone rubber (thickness 2 mm, hardness 10° (measured by type A durometer of JIS K 6253/ISO 7619)) and is coated by PFA(perfluoroalkoxy 30 μm) is provided. Instead of PFA, PTFE (polytetrafluoroethylene) can be also used for coating.

Pressure member 72 is pressed to fixing member 71 with a line pressure of 29.4 N/cm by an unillustrated urging member such as a spring and forms a nip area with elastic distortion. At this stage, a distance of nip area in a lateral direction is about 10.5 mm depending on a line pressure and a hardness of the roller surface.

Fixing member 71 rotates at a circumferential velocity of 350 to 410 mm/s in a clockwise direction, and pressure member 72 is pressed against fixing member 71 to be driven to rotate.

Cleaning device 73 collects paper dust and toner adhering to the surface of fixing member 71 to clean the surface of fixing member 71. Web 732 makes contact with the surface of fixing member 71 and winding roller 731 winds web 732, and thereby toner and paper dust are collected from the surface of fixing member 71.

Separation claw 74 is to separate the recording material adhering on the surface of fixing member 71 to prevent the recording material from wining around fixing member 71. If separation claw 74 stationary contacts with fixing member 71 at the same position, separation claw 74 will cause the streak line scratch on the surface of fixing roller 71 therefore, separation claw 74 reciprocates left and right along a longitudinal direction of fixing member 71.

Figure 3:
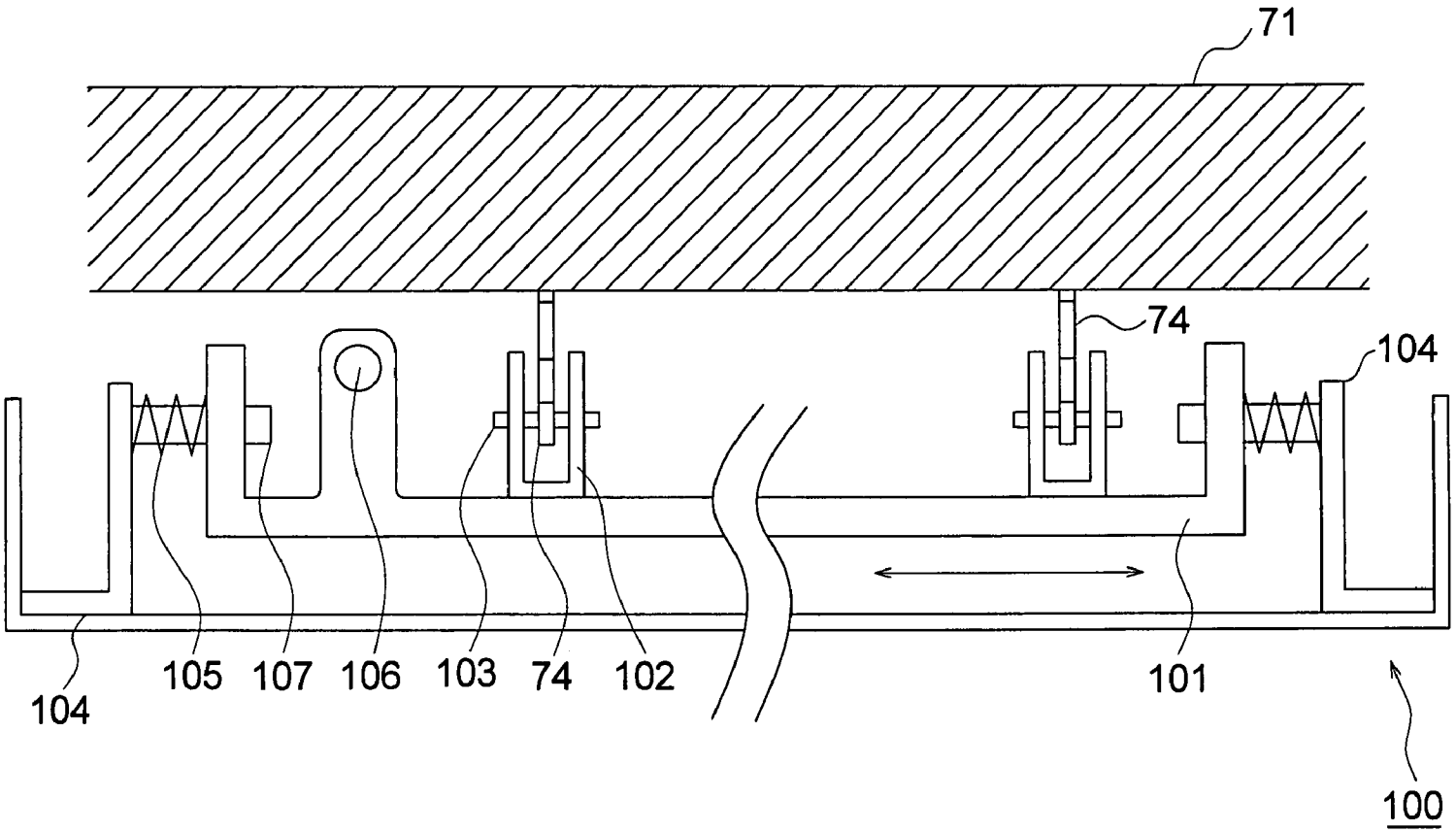
FIG. 3 is a plan view of separation claw moving device 100 observed from the top of fixing device 7.
Figure 4:
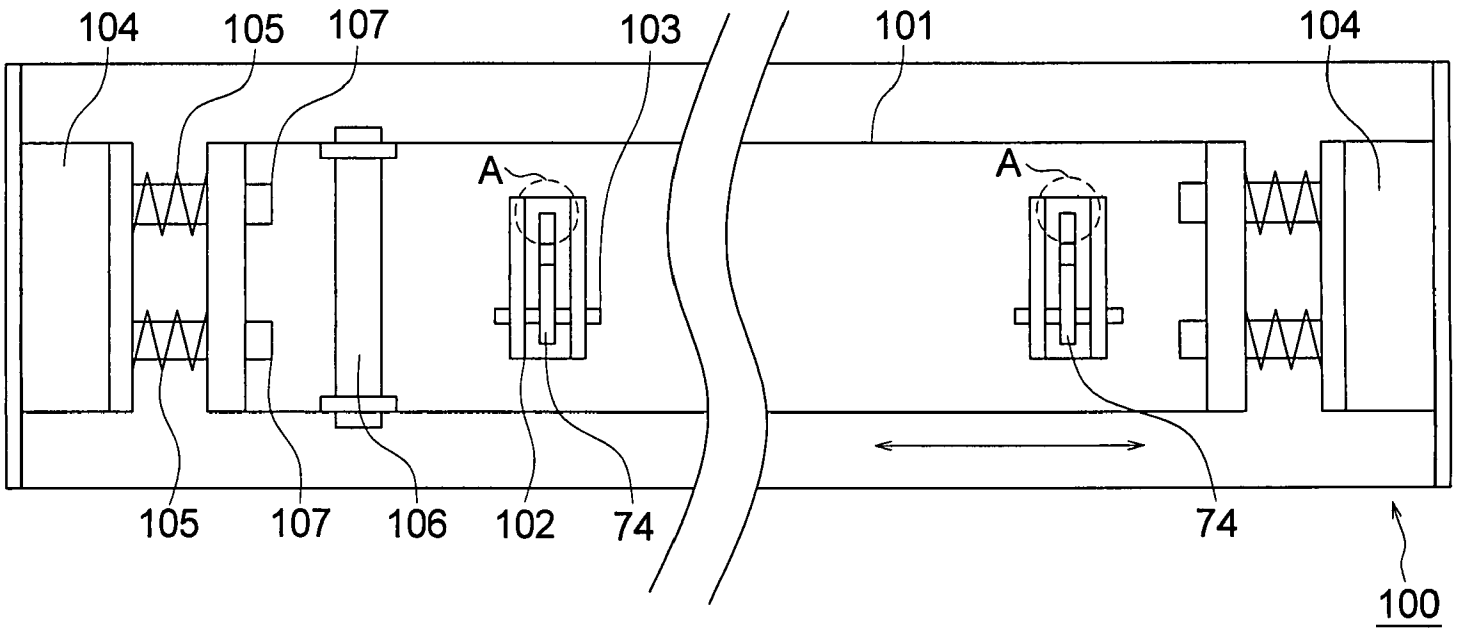
FIG. 4 is a plan view of separation claw moving device 100 observed from fixing member 71 side.
Figure 5:
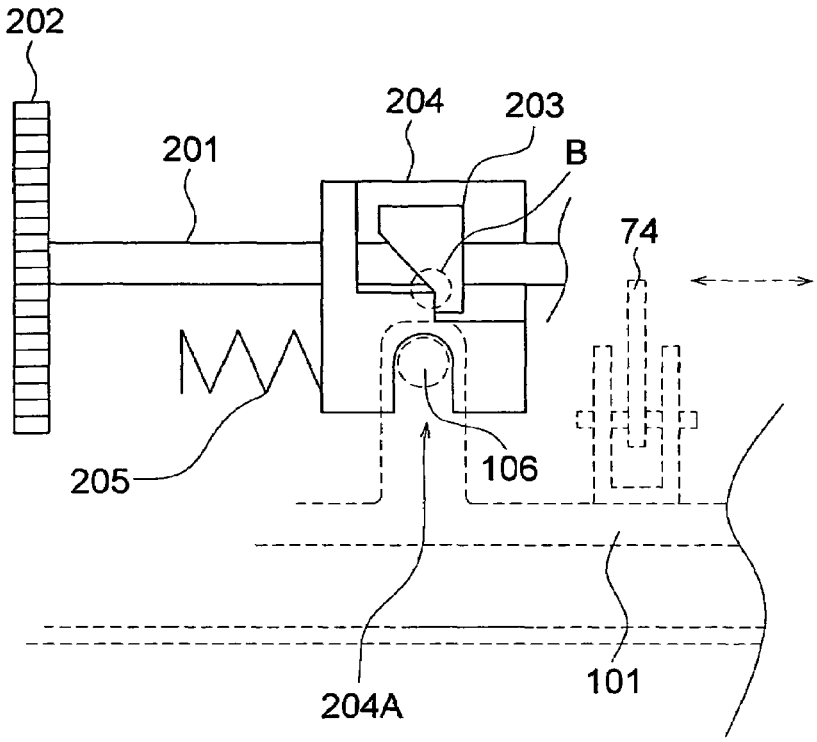
FIG. 5 is a drawing showing a cam mechanism to move separation claw 74.

Separation claw moving device 100 to move separation claw 74 along the surface of fixing member 71 is explained, referring to FIG. 3 to FIG. 5.

FIG. 3 is a top plan view of separation claw moving device 100 observed from upper surface of fixing device 7, and FIG. 4 is a side plan view of separation claw moving device 100 observed from fixing member 71 side.

As FIG. 3 shows, a plurality of separation claws is provided along the surface of fixing member 71. The reason of provision of a plurality of separation claws is to separate recording material from fixing member 71 in good condition. Areas A enclosed by broken lines in FIG. 4 are positions where separation claws 74 make contact with fixing member 71. Though two separation claws 74 are shown in each of FIG. 3 and FIG. 4, more than two separation claws 74 may also be provided along the surface of fixing member 71.

An unillustrated opening is provided on a part of separation claw 74. Separation claw retaining shaft 103 penetrates through the opening. The both ends of separation claw retaining shaft 103 are supported by U-shaped separation claw supporting section 102. With this structure, separation claw 74 is supported by separation claw support section 102 through separation claw retaining shaft 103.

Separation claw support section 102 is fixed on moving plate 101, so that, if moving plat 101 moves in a longitudinal direction (a direction shown by arrows in FIG. 3 and FIG. 4), separation claw support section 102 also moves together with moving plate 101. As FIG. 3 shows, both ends of moving plate 101 are bent to form the shape of a U. Each of the bent portions at both ends of moving plate 101 has a plurality of openings (unillustrated) and a plurality of moving plate retaining shafts 107 penetrate through the openings. An end of moving plate retaining shaft 107 is supported by L-shaped moving plate support section 104. Moving plate urging springs 105 are provided in the vicinity of each moving plate supporting shaft 107 so as to press moving plate 101.

Moving plate 101 is provided with moving shaft 106. By inserting moving shaft 106 to block channel 204A to be hereinafter described, separation claws 74 can move in a longitudinal direction.

FIG. 5 is a diagram showing a cam mechanism to move separation claws 74.

Numeral 201 shows a camshaft, numeral 202 shows a camshaft gearwheel provided on the camshaft and numeral 203 shows a cam provided on the camshaft. Drive power is transmitted to camshaft 201 through camshaft gearwheel 202 from power source. Cam 203 rotates together with camshaft 201 when camshaft 201 rotates.

Numeral 204 is a block which comes in contact with cam 203 and a U-shaped block channel 204A is provided in a part of block 204. Also block urging spring 205 is in contact with a part of block 204 to press block 204 rightward in FIG. 5.

A mechanism in which separation claw 74 moves along the surface of fixing member 71 is explained. Firstly, drive power is transmitted to camshaft 201 through camshaft gearwheel 202 from the power source, then camshaft 201 and cam 203 rotate. When cam 203 rotates, block 204, which is in contact with cam 203 in area B enclosed by broken lines in FIG. 5, moves in a parallel direction to camshaft 201 following the shape of the cam. As moving shaft 106 is inserted in block channel 204A of block 204, moving plate 101 moves along with the movement of block 204. With the above mechanism, separation claw 74 reciprocates in the longitudinal direction along the surface of fixing member 71 as shown by the broken lines in FIG. 5.

Figure 6:
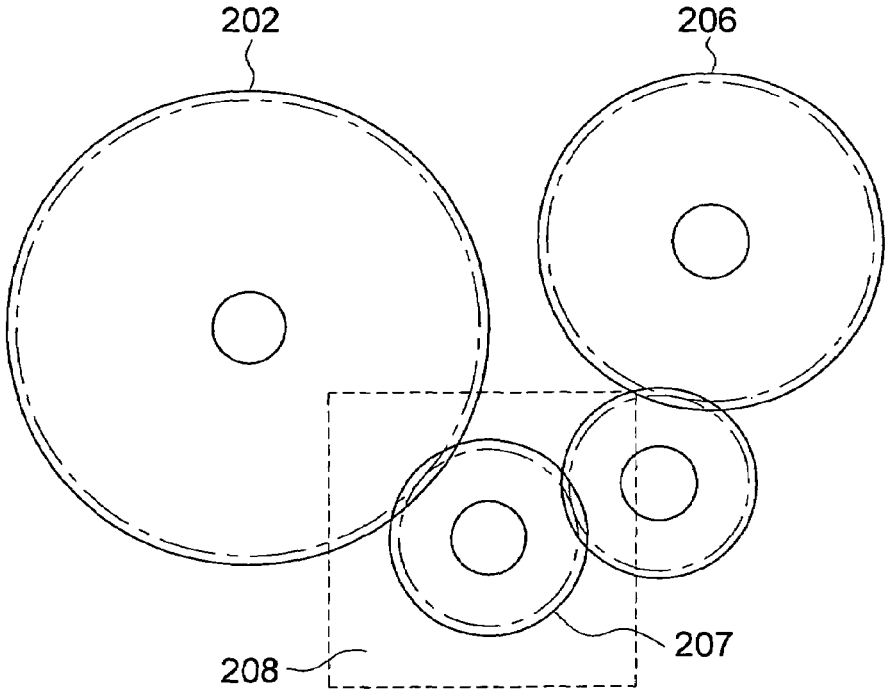
FIG. 6 is a drawing showing a drive system to move separation claw 74.
Figure 7:
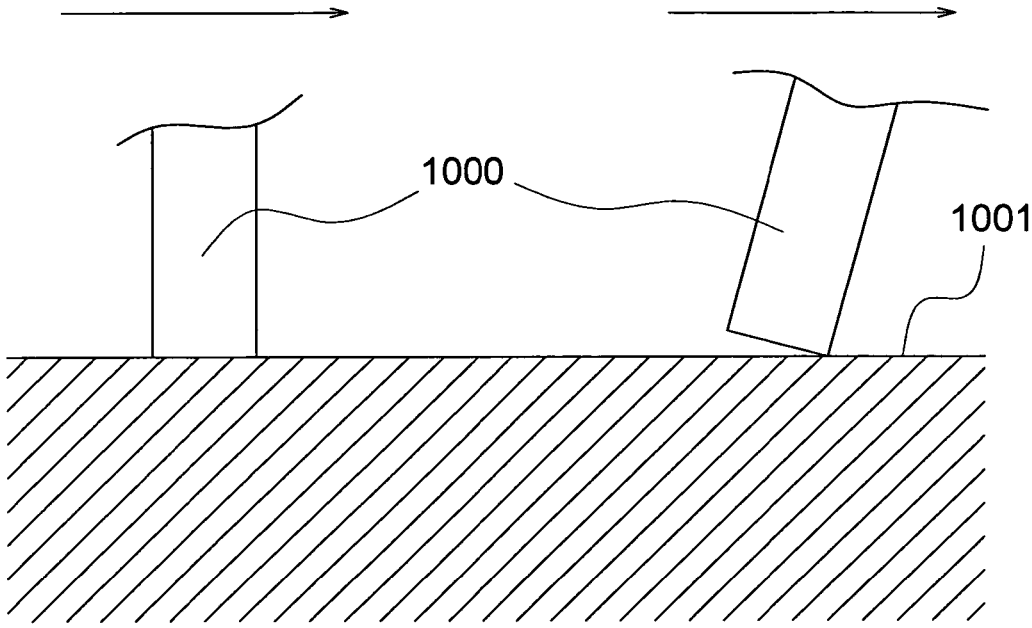
FIG. 7 is a drawing to explain bias contact phenomenon of the separation claw.

FIG. 6 is a diagram showing a drive system to move separation claw 74.

Numeral 206 is a cleaning gearwheel provided on winding roller 731 (refer FIG. 2). Numeral 208 is a motor, numeral 207 is a drive gearwheel provided on the motor. Drive gearwheel 207 is engaged with cleaning gearwheel 206 through a gearwheel. When drive gearwheel 207 rotates, cleaning device 73 can operates. Also camshaft gearwheel 202 to move separation claw 74 is engaged with drive gearwheel 207, and by transmitting drive power of motor 208, separation claw 74 reciprocates in the longitudinal direction along the surface of fixing member 71. As stated above, the power source to operate winding roller 731 which constructs a part of cleaning device 73, also moves separation claw 74, so that there is no need to provide an additional drive motor to move separation claw 74, which realizes cost reduction and space saving.

As explained using FIG. 3 to FIG. 6, separation claw 74 reciprocates in the longitudinal direction (axial direction) along the surface of fixing member 71. If the moving velocity of separation claw 74 is low, a scratch which can create a defect in the image on the recording material will occur on the surface of fixing member 71. Therefore, the moving velocity of separation claw 74 which does not create defects in the image of the recording material is studied through experimental tests. The results are shown in Table 1 to Table 3. Meanwhile, the moving velocity of the separation claw means a moving distance of separation claw 74, which moves along the surface of fixing member 71, per unit time.

TABLE 1

| Material Of separation claw | Surface Of fixing member | Contact load | Contact width | V1 | V2 | V3 | V4 | V5 |
|---|---|---|---|---|---|---|---|---|
| PEEK | PFA Tube | 1 × 9.8 | 1.0 | A | A | A | A | A |
| | | 1 × 9.8 | 1.5 | A | A | A | A | A |
| | | 1 × 9.8 | 3.0 | A | A | A | A | A |
| | | 1 × 9.8 | 4.5 | A | A | A | A | A |
| | | 5 × 9.8 | 1.0 | C | C | A | A | A |
| | | 5 × 9.8 | 1.5 | C | C | A | A | A |
| | | 5 × 9.8 | 3.0 | C | B | A | A | A |
| | | 5 × 9.8 | 4.5 | B | A | A | A | A |
| | | 10 × 9.8 | 1.0 | C | C | A | A | A |
| | | 10 × 9.8 | 1.5 | C | C | A | A | A |

TABLE 1-continued

| Material Of separation claw | Surface Of fixing member | Contact load | Contact width | V1 | V2 | V3 | V4 | V5 |
|---|---|---|---|---|---|---|---|---|
| | | 10 × 9.8 | 3.0 | C | B | A | A | A |
| | | 10 × 9.8 | 4.5 | C | A | A | A | A |
| | | 20 × 9.8 | 1.0 | C | C | A | A | A |
| | | 20 × 9.8 | 1.5 | C | C | A | A | A |
| | | 20 × 9.8 | 3.0 | C | C | A | A | A |
| | | 20 × 9.8 | 4.5 | C | B | A | A | A |
| | PTEF coat | 1 × 9.8 | 1.0 | A | A | A | A | A |
| | | 1 × 9.8 | 1.5 | A | A | A | A | A |
| | | 1 × 9.8 | 3.0 | A | A | A | A | A |
| | | 1 × 9.8 | 4.5 | A | A | A | A | A |
| | | 5 × 9.8 | 1.0 | C | C | A | A | A |
| | | 5 × 9.8 | 1.5 | C | C | A | A | A |
| | | 5 × 9.8 | 3.0 | C | B | A | A | A |
| | | 5 × 9.8 | 4.5 | B | A | A | A | A |
| | | 10 × 9.8 | 1.0 | C | C | A | A | A |
| | | 10 × 9.8 | 1.5 | C | C | A | A | A |
| | | 10 × 9.8 | 3.0 | C | B | A | A | A |
| | | 10 × 9.8 | 4.5 | C | A | A | A | A |
| | | 20 × 9.8 | 1.0 | C | C | A | A | A |
| | | 20 × 9.8 | 1.5 | C | C | A | A | A |
| | | 20 × 9.8 | 3.0 | C | C | A | A | A |
| | | 20 × 9.8 | 4.5 | C | C | A | A | A |

TABLE 2

| Material Of separation claw | Surface Of fixing member | Contact load | Contact width | V1 | V2 | V3 | V4 | V5 |
|---|---|---|---|---|---|---|---|---|
| PEEK | PFA Tube | 1 × 9.8 | 1.0 | A | A | A | A | A |
| | | 1 × 9.8 | 1.5 | A | A | A | A | A |
| | | 1 × 9.8 | 3.0 | A | A | A | A | A |
| | | 1 × 9.8 | 4.5 | A | A | A | A | A |
| | | 5 × 9.8 | 1.0 | C | C | A | A | A |
| | | 5 × 9.8 | 1.5 | C | C | A | A | A |
| | | 5 × 9.8 | 3.0 | B | B | A | A | A |
| | | 5 × 9.8 | 4.5 | B | A | A | A | A |
| | | 10 × 9.8 | 1.0 | C | C | A | A | A |
| | | 10 × 9.8 | 1.5 | C | C | A | A | A |
| | | 10 × 9.8 | 3.0 | B | B | A | A | A |
| | | 10 × 9.8 | 4.5 | B | A | A | A | A |
| | | 20 × 9.8 | 1.0 | C | C | A | A | A |
| | | 20 × 9.8 | 1.5 | C | C | A | A | A |
| | | 20 × 9.8 | 3.0 | C | C | A | A | A |
| | | 20 × 9.8 | 4.5 | C | B | A | A | A |
| | PTEF coat | 1 × 9.8 | 1.0 | A | A | A | A | A |
| | | 1 × 9.8 | 1.5 | A | A | A | A | A |
| | | 1 × 9.8 | 3.0 | A | A | A | A | A |
| | | 1 × 9.8 | 4.5 | A | A | A | A | A |
| | | 5 × 9.8 | 1.0 | C | C | A | A | A |
| | | 5 × 9.8 | 1.5 | C | C | A | A | A |
| | | 5 × 9.8 | 3.0 | B | B | A | A | A |
| | | 5 × 9.8 | 4.5 | B | A | A | A | A |
| | | 10 × 9.8 | 1.0 | C | C | A | A | A |
| | | 10 × 9.8 | 1.5 | C | C | A | A | A |
| | | 10 × 9.8 | 3.0 | B | B | A | A | A |
| | | 10 × 9.8 | 4.5 | B | A | A | A | A |
| | | 20 × 9.8 | 1.0 | C | C | A | A | A |
| | | 20 × 9.8 | 1.5 | C | C | A | A | A |
| | | 20 × 9.8 | 3.0 | C | B | A | A | A |
| | | 20 × 9.8 | 4.5 | C | B | A | A | A |

TABLE 3

| Material Of separation claw | Surface Of fixing member | Contact load | Contact width | V1 | V2 | V3 | V4 | V5 |
|---|---|---|---|---|---|---|---|---|
| PEEK | PFA Tube | 1 × 9.8 | 1.0 | A | A | A | A | A |
| | | 1 × 9.8 | 1.5 | A | A | A | A | A |
| | | 1 × 9.8 | 3.0 | A | A | A | A | A |
| | | 1 × 9.8 | 4.5 | A | A | A | A | A |
| | | 5 × 9.8 | 1.0 | C | C | A | A | A |
| | | 5 × 9.8 | 1.5 | C | C | A | A | A |
| | | 5 × 9.8 | 3.0 | B | B | A | A | A |
| | | 5 × 9.8 | 4.5 | B | A | A | A | A |
| | | 10 × 9.8 | 1.0 | C | C | A | A | A |
| | | 10 × 9.8 | 1.5 | C | C | A | A | A |
| | | 10 × 9.8 | 3.0 | C | B | A | A | A |
| | | 10 × 9.8 | 4.5 | B | A | A | A | A |
| | | 20 × 9.8 | 1.0 | C | C | A | A | A |
| | | 20 × 9.8 | 1.5 | C | C | A | A | A |
| | | 20 × 9.8 | 3.0 | C | C | A | A | A |
| | | 20 × 9.8 | 4.5 | C | B | A | A | A |
| | PTEF coat | 1 × 9.8 | 1.0 | A | A | A | A | A |
| | | 1 × 9.8 | 1.5 | A | A | A | A | A |
| | | 1 × 9.8 | 3.0 | A | A | A | A | A |
| | | 1 × 9.8 | 4.5 | A | A | A | A | A |
| | | 5 × 9.8 | 1.0 | C | C | A | A | A |
| | | 5 × 9.8 | 1.5 | C | C | A | A | A |
| | | 5 × 9.8 | 3.0 | B | B | A | A | A |
| | | 5 × 9.8 | 4.5 | B | A | A | A | A |
| | | 10 × 9.8 | 1.0 | C | C | A | A | A |
| | | 10 × 9.8 | 1.5 | C | C | A | A | A |
| | | 10 × 9.8 | 3.0 | C | B | A | A | A |
| | | 10 × 9.8 | 4.5 | B | A | A | A | A |
| | | 20 × 9.8 | 1.0 | C | C | A | A | A |
| | | 20 × 9.8 | 1.5 | C | C | A | A | A |
| | | 20 × 9.8 | 3.0 | C | C | A | A | A |
| | | 20 × 9.8 | 4.5 | C | C | A | A | A |

As the factors to create the scratches on the surface of fixing member 71, moving velocity of separation claw 74, a material of separation claw 74, a surface layer of fixing material 71, a contact load on separation claw 74, and a contact width of separation claw 74 are presumed. Therefore, the experimental tests were carried out combining these factors. The moving velocity of separation claw 74 was varied in 5 steps, i.e. V1 ($5\times10^{4}$ mm/s), V2 ($7.5\times10^{-4}$ mm/s), V3 ($1\times10^{-3}$ mm/s), V4 ($1.6\times10^{-3}$ mm/s) and V5 ($2\times10^{-3}$ mm/s). As the materials of separation claw, 3 kinds i.e. PEEK (polyehter etherketone), PAI (polyamidoimide) and PI (polyimide) were used. As the surface layer of fixing member 71, PFA tube and PTFE coating were used. The contact load of separation claw 74 was varied in 4 steps i.e. 1×9.8 mN, 5×9.8 mN, 10×9.8 mN and 20×9.8 mN, and the contact width of separation claw 74 was varied in 4 steps i.e. 1 mm, 1.5 mm, 3 mm and 4.5 mm, in the experimental test. The image on the 100,000th solid black print was used for evaluation. In the tables, A means that no image defects caused by separation claw 74 exist, B means that slight image defects caused by separation claw 74 exist and C means that image defects caused by separation claw 74 exist. As the results of the experiments in the table 1 to table 3 show, it was found that if the velocity of separation claw 74 is not less than $1\times10^{-3}$ mm/s, no image defects exist irrespective of combination of the materials of separation claw 74.

On the other hand, if the velocity of separation claw 74 is high, the aforesaid bias contact phenomenon and a problem in separation performance of the separation claw occurred. Thus, the moving velocity of separation claw to reduce the bias contact phenomenon and to maintain separation performance was studied through experimental tests. The results are shown in the Table 4.

TABLE 4

| Moving velocity of the separation claw (mm/s) | Bias contact phenomenon |
|---|---|
| 0.01 | A |
| 0.05 | A |
| 0.06 | A |
| 0.08 | A |
| 0.1 | A |
| 0.12 | B |
| 0.15 | C |
| 0.2 | C |
| 0.3 | C |

A: Not occurred, B: Slightly occurred, C: Occurred

The velocity of separation claw 74 was varied in 9 steps in the experimental tests. As the results in Table 4 show, it was found that if the velocity of separation claw 74 is not more than 0.1 mm/s, the bias contact phenomenon does not occur.

Also, the occurrence rate of scratch can be reduced, by adjusting the contact load and the contact width of separation claw 74. Therefore, Table 5 shows the results of the experimental test where the contact width and the contact load were varied.

The contact load of separation claw 74 was in a range of 1×9.8 mN to 5×9.8 mN and the contact width of separation claw 74 was varied in 6 steps i.e. 0.5 mm, 1.0 mm, 1.5 mm, 3.0 mm, 4.5 mm and 5.0 mm to carry out the experimental test. Also, 3 kinds of the material of separation claw i.e. 74 PEEK, PAI and PI, and 2 kinds of the surface layer of the fixing member PFA tube and PTFE coating were used.

The contact efficiency in Table 5 is an index indicates whether or not separation claw 74 and the fixing member are in stable contact. If the contact load is low and the contact width of separation claw 74 is narrow, defects such as bias contact occur. Also, if the contact load is low, sheet separation performance decreases. In Table 5, "A" means separation claw 74 and the fixing member are in stable contact, "B" means the contact is rather unstable and "C" means the contact is unstable and defects occur.

The occurrence rate of scratches in Table 5 is an index indicates whether or not separation claw 74 cuts into the fixing member. For example, if the contact load is high, scratches occur on the fixing member in a process of releasing of guide plate (not illustrated) of separation claw 74 from contact. In Table 5, "A" means no adverse affect by separation claw 74 to the fixing member, "B" means there is a possibility of occurring scratches and "C" means scratches occur on the fixing member. Meanwhile, if the width of separation claw is lager than 5.0 mm, other mechanisms need to be modified.

From the results of Table 5, by setting contact load P of separation claw 74 as $3.0\times9.8\text{ mN}\leqq P\leqq7.0\times9.8\text{ mN}$ and by setting the width W of claw 74 as $1.0\text{ mm}\leqq W\leqq5.0\text{ mm}$, scratches on the fixing member can be prevented and defects in images can be reduced. Also, the experimental test of Table 5 was carried out while separation claw 74 is fixed however, by setting the moving velocity of separation claw 74 in the aforesaid range, it is needless to say that better images with less defects can be formed.

TABLE 5

| Contact load | Contact width | Contact efficiency | Occurrence rate of scratch |
|---|---|---|---|
| 1 × 9.8 | 0.5 | C | A |
| 1 × 9.8 | 1.0 | C | A |
| 1 × 9.8 | 1.5 | C | A |
| 1 × 9.8 | 3.0 | C | A |

TABLE 5-continued

| Contact load | Contact width | Contact efficiency | Occurrence rate of scratch |
|---|---|---|---|
| 1 × 9.8 | 4.5 | C | A |
| 1 × 9.8 | 5.0 | C | A |
| 1.5 × 9.8 | 0.5 | C | A |
| 1.5 × 9.8 | 1.0 | B | A |
| 1.5 × 9.8 | 1.5 | B | A |
| 1.5 × 9.8 | 3.0 | B | A |
| 1.5 × 9.8 | 4.5 | B | A |
| 1.5 × 9.8 | 5.0 | B | A |
| 2 × 9.8 | 0.5 | C | A |
| 2 × 9.8 | 1.0 | C | A |
| 2 × 9.8 | 1.5 | B | A |
| 2 × 9.8 | 3.0 | B | A |
| 2 × 9.8 | 4.5 | B | A |
| 2 × 9.8 | 5.0 | B | A |
| 2.5 × 9.8 | 0.5 | C | A |
| 2.5 × 9.8 | 1.0 | C | A |
| 2.5 × 9.8 | 1.5 | B | A |
| 2.5 × 9.8 | 3.0 | B | A |
| 2.5 × 9.8 | 4.5 | B | A |
| 2.5 × 9.8 | 5.0 | B | A |
| 3 × 9.8 | 0.5 | C | A |
| 3 × 9.8 | 1.0 | A | A |
| 3 × 9.8 | 1.5 | A | A |
| 3 × 9.8 | 3.0 | A | A |
| 3 × 9.8 | 4.5 | A | A |
| 3 × 9.8 | 5.0 | A | A |
| 3.5 × 9.8 | 0.5 | C | A |
| 3.5 × 9.8 | 1.0 | A | A |
| 3.5 × 9.8 | 1.5 | A | A |
| 3.5 × 9.8 | 3.0 | A | A |
| 3.5 × 9.8 | 4.5 | A | A |
| 3.5 × 9.8 | 5.0 | A | A |
| 4 × 9.8 | 0.5 | C | A |
| 4 × 9.8 | 1.0 | A | A |
| 4 × 9.8 | 1.5 | A | A |
| 4 × 9.8 | 3.0 | A | A |
| 4 × 9.8 | 4.5 | A | A |
| 4 × 9.8 | 5.0 | A | A |
| 4.5 × 9.8 | 0.5 | C | A |
| 4.5 × 9.8 | 1.0 | A | A |
| 4.5 × 9.8 | 1.5 | A | A |
| 4.5 × 9.8 | 3.0 | A | A |
| 4.5 × 9.8 | 4.5 | A | A |
| 4.5 × 9.8 | 5.0 | A | A |
| 5 × 9.8 | 0.5 | C | A |
| 5 × 9.8 | 1.0 | A | A |
| 5 × 9.8 | 1.5 | A | A |
| 5 × 9.8 | 3.0 | A | A |
| 5 × 9.8 | 4.5 | A | A |
| 5 × 9.8 | 5.0 | A | A |
| 5.5 × 9.8 | 0.5 | C | A |
| 5.5 × 9.8 | 1.0 | A | A |
| 5.5 × 9.8 | 1.5 | A | A |
| 5.5 × 9.8 | 3.0 | A | A |
| 5.5 × 9.8 | 4.5 | A | A |
| 5.5 × 9.8 | 5.0 | A | A |
| 6 × 9.8 | 0.5 | C | A |
| 6 × 9.8 | 1.0 | A | A |
| 6 × 9.8 | 1.5 | A | A |
| 6 × 9.8 | 3.0 | A | A |
| 6 × 9.8 | 4.5 | A | A |
| 6 × 9.8 | 5.0 | A | A |
| 6.5 × 9.8 | 0.5 | C | A |
| 6.5 × 9.8 | 1.0 | A | A |
| 6.5 × 9.8 | 1.5 | A | A |
| 6.5 × 9.8 | 3.0 | A | A |
| 6.5 × 9.8 | 4.5 | A | A |
| 6.5 × 9.8 | 5.0 | A | A |
| 7 × 9.8 | 0.5 | C | A |
| 7 × 9.8 | 1.0 | A | A |
| 7 × 9.8 | 1.5 | A | A |
| 7 × 9.8 | 3.0 | A | A |
| 7 × 9.8 | 4.5 | A | A |
| 7 × 9.8 | 5.0 | A | A |
| 7.5 × 9.8 | 0.5 | C | A |
| 7.5 × 9.8 | 1.0 | A | A |

TABLE 5-continued

| Contact load | Contact width | Contact efficiency | Occurrence rate of scratch |
|---|---|---|---|
| 7.5 × 9.8 | 1.5 | A | A |
| 7.5 × 9.8 | 3.0 | A | A |
| 7.5 × 9.8 | 4.5 | A | A |
| 7.5 × 9.8 | 5.0 | A | A |
| 8 × 9.8 | 0.5 | C | A |
| 8 × 9.8 | 1.0 | A | A |
| 8 × 9.8 | 1.5 | A | A |
| 8 × 9.8 | 3.0 | A | A |
| 8 × 9.8 | 4.5 | A | A |
| 8 × 9.8 | 5.0 | A | A |
| 8.5 × 9.8 | 0.5 | C | A |
| 8.5 × 9.8 | 1.0 | A | A |
| 8.5 × 9.8 | 1.5 | A | A |
| 8.5 × 9.8 | 3.0 | A | A |
| 8.5 × 9.8 | 4.5 | A | A |
| 8.5 × 9.8 | 5.0 | A | A |
| 9 × 9.8 | 0.5 | C | A |
| 9 × 9.8 | 1.0 | A | A |
| 9 × 9.8 | 1.5 | A | A |
| 9 × 9.8 | 3.0 | A | A |
| 9 × 9.8 | 4.5 | A | A |
| 9 × 9.8 | 5.0 | A | A |
| 9.5 × 9.8 | 0.5 | C | A |
| 9.5 × 9.8 | 1.0 | A | A |
| 9.5 × 9.8 | 1.5 | A | A |
| 9.5 × 9.8 | 3.0 | A | A |
| 9.5 × 9.8 | 4.5 | A | A |
| 9.5 × 9.8 | 5.0 | A | A |
| 10 × 9.8 | 0.5 | C | A |
| 10 × 9.8 | 1.0 | A | A |
| 10 × 9.8 | 1.5 | A | A |
| 10 × 9.8 | 3.0 | A | A |
| 10 × 9.8 | 4.5 | A | A |
| 10 × 9.8 | 5.0 | A | A |
| 10.5 × 9.8 | 0.5 | C | B |
| 10.5 × 9.8 | 1.0 | A | B |
| 10.5 × 9.8 | 1.5 | A | B |
| 10.5 × 9.8 | 3.0 | A | B |
| 10.5 × 9.8 | 4.5 | A | B |
| 10.5 × 9.8 | 5.0 | A | B |
| 11 × 9.8 | 0.5 | C | B |
| 11 × 9.8 | 1.0 | A | B |
| 11 × 9.8 | 1.5 | A | B |
| 11 × 9.8 | 3.0 | A | B |
| 11 × 9.8 | 4.5 | A | B |
| 11 × 9.8 | 5.0 | A | B |
| 11.5 × 9.8 | 0.5 | C | B |
| 11.5 × 9.8 | 1.0 | A | B |
| 11.5 × 9.8 | 1.5 | A | B |
| 11.5 × 9.8 | 3.0 | A | B |
| 11.5 × 9.8 | 4.5 | A | B |
| 11.5 × 9.8 | 5.0 | A | B |
| 12 × 9.8 | 0.5 | C | B |
| 12 × 9.8 | 1.0 | A | B |
| 12 × 9.8 | 1.5 | A | B |
| 12 × 9.8 | 3.0 | A | B |
| 12 × 9.8 | 4.5 | A | B |
| 12 × 9.8 | 5.0 | A | B |
| 12.5 × 9.8 | 0.5 | C | B |
| 12.5 × 9.8 | 1.0 | A | B |
| 12.5 × 9.8 | 1.5 | A | B |
| 12.5 × 9.8 | 3.0 | A | B |
| 12.5 × 9.8 | 4.5 | A | B |
| 12.5 × 9.8 | 5.0 | A | B |
| 13 × 9.8 | 0.5 | C | B |
| 13 × 9.8 | 1.0 | A | B |
| 13 × 9.8 | 1.5 | A | B |
| 13 × 9.8 | 3.0 | A | B |
| 13 × 9.8 | 4.5 | A | B |
| 13 × 9.8 | 5.0 | A | B |
| 13.5 × 9.8 | 0.5 | C | B |
| 13.5 × 9.8 | 1.0 | A | B |
| 13.5 × 9.8 | 1.5 | A | B |
| 13.5 × 9.8 | 3.0 | A | B |
| 13.5 × 9.8 | 4.5 | A | B |
| 13.5 × 9.8 | 5.0 | A | B |

TABLE 5-continued

| Contact load | Contact width | Contact efficiency | Occurrence rate of scratch |
|---|---|---|---|
| 14 × 9.8 | 0.5 | C | C |
| 14 × 9.8 | 1.0 | A | C |
| 14 × 9.8 | 1.5 | A | C |
| 14 × 9.8 | 3.0 | A | C |
| 14 × 9.8 | 4.5 | A | C |
| 14 × 9.8 | 5.0 | A | C |
| 14.5 × 9.8 | 0.5 | C | C |
| 14.5 × 9.8 | 1.0 | A | C |
| 14.5 × 9.8 | 1.5 | A | C |
| 14.5 × 9.8 | 3.0 | A | C |
| 14.5 × 9.8 | 4.5 | A | C |
| 14.5 × 9.8 | 5.0 | A | C |
| 15 × 9.8 | 0.5 | C | C |
| 15 × 9.8 | 1.0 | A | C |
| 15 × 9.8 | 1.5 | A | C |
| 15 × 9.8 | 3.0 | A | C |
| 15 × 9.8 | 4.5 | A | C |
| 15 × 9.8 | 5.0 | A | C |
| 15.5 × 9.8 | 0.5 | C | C |
| 15.5 × 9.8 | 1.0 | A | C |
| 15.5 × 9.8 | 1.5 | A | C |
| 15.5 × 9.8 | 3.0 | A | C |
| 15.5 × 9.8 | 4.5 | A | C |
| 15.5 × 9.8 | 5.0 | A | C |

From the above results, if the velocity of separation claw 74 is set in a range of $1\times10^{-3}$ mm/s≦V≦0.1 mm/s, excellent image forming where defects are reduced can be realized, and separation performance by the separation claw can be well maintained.

Meanwhile, the present invention is not to be considered limited to the embodiments shown in the drawings and described in the specification, and it can naturally exhibit its effect even for other embodiments of fixing devices and image forming apparatuses.

What is claimed is:

1. A fixing device comprising:

a fixing member which fixes a toner image on a sheet;

a separating claw which is in contact with the fixing member to separate the sheet from the fixing member; and a claw moving section to move the separating claw along a surface of the fixing member in a direction parallel to a rotation axis of the fixing member at a velocity V which satisfies a formula that 0.001 mm/s≦V≦0.1 mm/s, wherein the fixing member moves at a circumferential velocity of 350 mm/sec or above.

2. The fixing device of claim 1, further comprising:

a cleaning section which cleans the surface of the fixing member; and a drive unit which drives the cleaning section and the claw moving section.

3. The fixing device of claim 1, wherein the fixing member is a heat roller, which melts toner on the sheet and fixes a toner image.

4. The fixing device of claim 1, wherein a width W of the separation claw in a moving direction satisfies a formula that 0.1 mm≦W≦5.0 mm, and a driving power control section to control contact load P of the separation claw, applied to the fixing member, so as to satisfy a formula that 3.0×9.8 mN≦P≦7.0×9.8 mN.

* * * * *